US007916083B2

(12) United States Patent
Thiesen et al.

(10) Patent No.: US 7,916,083 B2
(45) Date of Patent: Mar. 29, 2011

(54) VERTICALLY INTEGRATED ELECTRONICALLY STEERED PHASED ARRAY AND METHOD FOR PACKAGING

(75) Inventors: Jack H. Thiesen, Plymouth, MI (US); Karl F. Brakora, Dexter, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 359 days.

(21) Appl. No.: 12/113,526

(22) Filed: May 1, 2008

(65) Prior Publication Data

US 2009/0273517 A1 Nov. 5, 2009

(51) Int. Cl.
*H01Q 3/00* (2006.01)

(52) U.S. Cl. ..... 342/372; 342/373

(58) Field of Classification Search ..... 342/372, 342/373; 343/700 MS
See application file for complete search history.

(56) References Cited

U.S. PATENT DOCUMENTS

| | | | | |
|---|---|---|---|---|
| 4,951,123 | A * | 8/1990 | Lee et al. | 257/720 |
| 2002/0186063 | A1 | 12/2002 | Lee et al. | |
| 2003/0017650 | A1 * | 1/2003 | Armbrust et al. | 438/122 |
| 2004/0008092 | A1 | 1/2004 | Hajimiri et al. | |
| 2004/0085249 | A1 * | 5/2004 | Kitamori et al. | 343/776 |
| 2004/0095287 | A1 | 5/2004 | Mohamadi | |
| 2004/0100405 | A1 | 5/2004 | Mohamadi | |
| 2005/0152488 | A1 | 7/2005 | Buckwalter et al. | |
| 2005/0161195 | A1 * | 7/2005 | Hein | 165/80.3 |
| 2005/0163207 | A1 | 7/2005 | Buckwalter et al. | |
| 2005/0227660 | A1 | 10/2005 | Hashemi et al. | |
| 2006/0061507 | A1 | 3/2006 | Mohamadi | |
| 2006/0121869 | A1 | 6/2006 | Natarajan et al. | |
| 2006/0164132 | A1 | 7/2006 | Martin et al. | |
| 2007/0296077 | A1 * | 12/2007 | Moline | 257/712 |

OTHER PUBLICATIONS

L. Breems et al., Continuous-Time Sigma-Delta Modulation for A/D Conversion in Radio Receivers, Kluwer Academic Publishers, p. 9-14, 2001.*

* cited by examiner

*Primary Examiner* — Thomas H Tarcza
*Assistant Examiner* — Fred H Mull
(74) *Attorney, Agent, or Firm* — John A. Miller; Miller IP Group, PLC

(57) ABSTRACT

A vertically integrated electronically steered phased array that employs beamsteering using a programmable phase locked loop including a local oscillator. The local oscillator provides an oscillator signal that is converted to an RF signal that can be either up-converted for a transmit operation or down-converted for a receive operation. The relative off-set between independently generated local oscillator signals forms the basis of the off-set phase required for a phased array. The absolute measure of off-set phase is referenced to a globally distributed clock signal that aligns the zero degree phase shift of the oscillator.

6 Claims, 9 Drawing Sheets

VERTICALLY INTEGRATED ELECTRONICALLY STEERED PHASED ARRAY AND METHOD FOR PACKAGING

BACKGROUND OF THE INVENTION

1. Field of the Invention

This invention relates generally to a vertically integrated electronically steered phased array and, more particularly, to a vertically integrated electronically steered phased array that is synchronized to a global clock signal applied to a local oscillator from a tunable phase-locked loop (PLL) in each channel of the array.

2. Discussion of the Related Art

Transceiver arrays are widely used in wireless communications, radar applications and sonar applications. A transceiver array is an array of transceiver channels each including an antenna where the channels combine to provide a directional beam for both transmitting and receiving purposes, including beam scanning. As the directivity of the array increases, the gain of the array also increases.

Various types of transceiver arrays are known in the art that provide beam steering. One known transceiver array type includes mounting individual transceiver front-end channels on a mechanical device that moves to provide beam steering or scanning.

Another known transceiver array type is a phased array. A typical phased array includes an antenna in each channel that is connected to a phase shifter, and a power combiner for adding the signals together from the antennas. The phase shifters control either the phase of the excitation current of the antenna for transmission or the phase of the receive signals. When the signals are combined, a beam is formed in a particular direction. Particularly, a transmit beam is formed in space, and a receive beam adds coherently if the signals are received from a particular region of space. The radiation pattern of the transceiver array is determined by the amplitude and phase of the current at each of the antennas. If only the phase of the signals is changed and the amplitude of the signals is fixed, the beam can be steered.

Another type of transceiver array employs digital beamforming systems have been developed in the art that eliminate the need for the phase shifters to provide beam steering. The digital beamforming systems digitally provide beam steering. One advantage of digital beamforming is that once the RF information from each channel is captured in the form of a digital stream, digital signal processing techniques and algorithms can be used to process the data in the spatial domain.

Digital beamforming is based on the conversion of the RF signal at each antenna into base-band signals. The beamforming is provided by weighting each digital signal from the channels, thereby adjusting their amplitude and phase so that when they are subsequently added together in post-processing they form the desired beam. Thus, the linear phase weight applied to the digitized signal at each channel can make the antenna beam appear as if it is steered to different angular directions.

SUMMARY OF THE INVENTION

In accordance with the teachings of the present invention, a vertically integrated electronically steered phased array is disclosed that employs beamsteering using a programmable phase locked loop including a local oscillator. The local oscillator provides an oscillator signal that is converted to an RF signal that can be either up-converted for a transmit operation or down-converted for a receive operation. The relative off-set between independently generated local oscillator signals forms the basis of the off-set phase required for a phased array. The absolute measure of off-set phase is referenced to a globally distributed clock signal that aligns the zero degree phase shift of the oscillator.

Additional features of the present invention will become apparent from the following description and appended claims, taken in conjunction with the accompanying drawings.

DETAILED DESCRIPTION OF THE EMBODIMENTS

The following discussion of the embodiments of the invention directed towards a vertically integrated phased array is merely exemplary in nature, and is in no way intended to limit the invention or its applications or uses.

Figure 1:
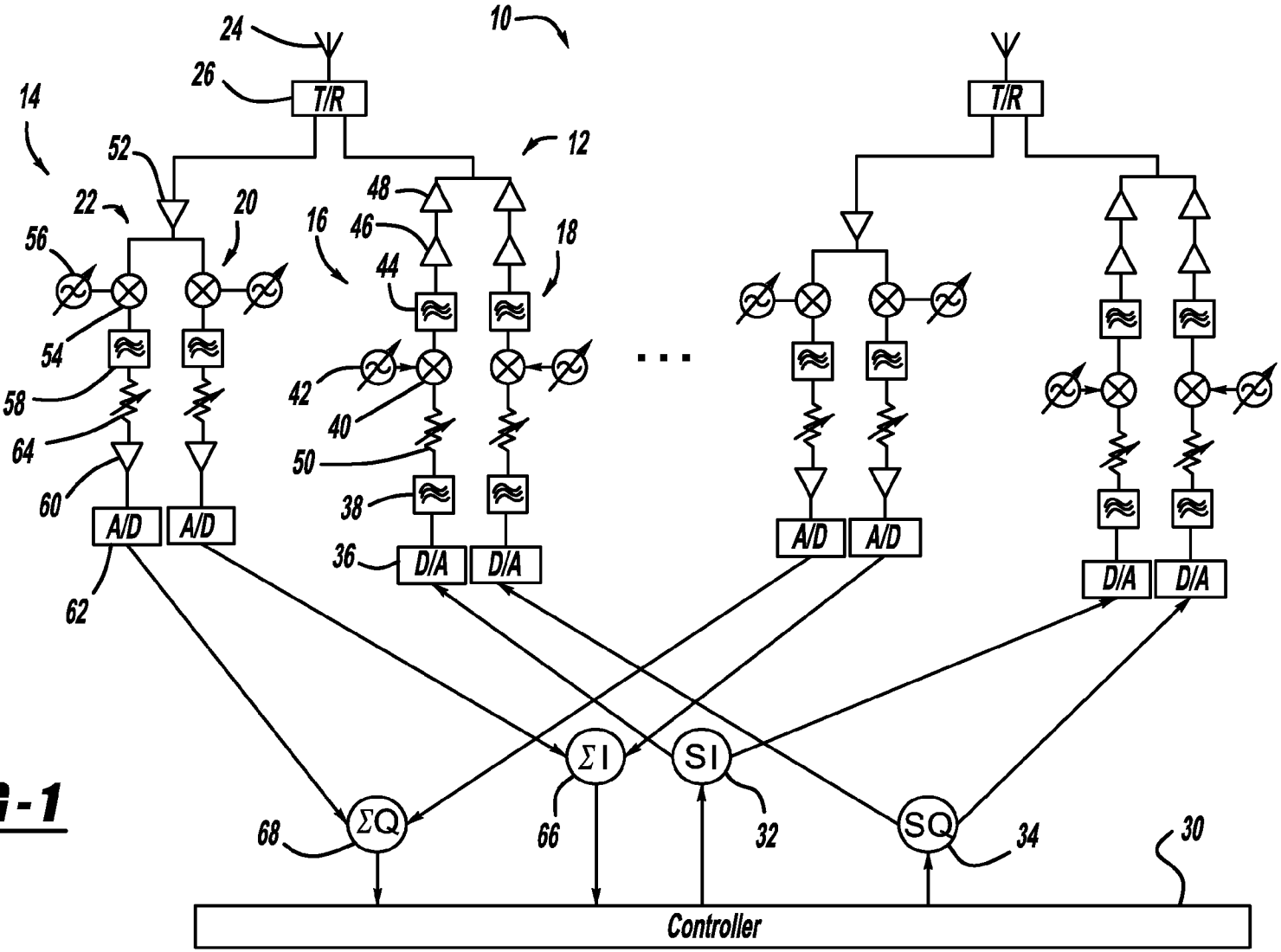
FIG. 1 is a schematic diagram of a vertically integrated electronically steered phased array, according to an embodiment of the present invention.

FIG. 1 is a block diagram of a transceiver phased array 10 including a plurality of transmit channels 12 and receive channels 14. Each of the transmit channels 12 includes an in-phase portion 16 and a quadrature phase portion 18. Likewise, each of the receive channels 14 includes an in-phase portion 20 and a quadrature phase portion 22. A separate antenna 24 is provided for a pair of a transmit channel 12 and a receive channel 14. A transmit/receive (T/R) switch 26 switches the antenna 24 between the transmit channel 12 and the receive channel 14 in a manner that is well understood to those skilled in the art. In an alternate design, a separate antenna may be provided for each receive channel 14 and each transmit channel 12. Further, it is not necessary to provide both in-phase and quadrature phase portions, where the in-phase portion and the quadrature phase portion could be combined into a single channel. In one design of this type, the mixers have the capability of rejecting the image of the mixing process where quadrature amplitude modulation is not desired.

A controller 30 provides beamforming and signal modulation and demodulation for the signals transmitted by each transmit channel 12 and the signals received by each receive channel 14. The phased array 10 can operate as a local oscillator (LO) phase steered array or a digital beamformer where the phase control is provided in the digital beamforming controller 30, as is well understood by those skilled in the art. A signal to be transmitted is sent to an in-phase splitter 32 and a quadrature phase splitter 34 that provide signals 90° apart in phase. The splitters 32 and 34 provide the in-phase signals and the quadrature phase signals to the appropriate in-phase portion 16 and quadrature phase portion 18 in each of the transmit channels 12. Each of the in-phase portions 16 and the quadrature phase portions 18 in each of the transmit channels 12 includes a digital-to-analog converter 36 that converts the digital signals to analog signals for transmission. The analog signal is then sent to an optical attenuator 50 if taper or balance is required and a high-pass filter 38 that filters the analog signal to a certain frequency band. The filtered analog signal is then sent to a mixer 40 along with a local oscillator signal from a local oscillator in a phase locked loop (PLL) 42 to up-convert the signal to a high frequency signal for transmission. A detailed schematic of the PLL 42 is not necessary for a proper understanding of the invention in that such circuit diagrams are well known to those skilled in the art.

As will be discussed in detail below, the PLL 42 is a programmable PLL that receives a clock signal that aligns the zero phase of the local oscillator signal. Control data is provided that establishes the phase off-set of the local oscillator with the edge of the clock signal. These control data sets the relative phase of the local oscillator in the PLL 42, and thus, controls the phase of the signal transmitted by the particular transmit channel 12 to provide beam steering in the phased array 10. The PLL 42 generates a frequency in the VCO and the digital data conditions the negative feedback loop of the PLL 42 to provide the off-set. It is the off-set with respect to the edge of the clock signal that sets the relative phase in the PLL 42 that can be changed to time shift the local oscillator signal to provide phase control. The PLLs 42 can be any PLL suitable for the purposes described herein, such as the PLL disclosed in U.S. Patent application publication 2006/0164132 to Martin et al. The high frequency signal may then be band-pass filtered by a filter 44 and amplified by power amplifiers 46 and 48 to be transmitted by the antenna 24.

When the transmit/receive switch 26 is switched to the receive mode, signals received by the antenna 24 are amplified by a low noise amplifier (LNA) 52, and then separated into the in-phase portion 20 and the quadrature phase portion 22 of the receive channel 14. In both of the in-phase portion 20 and the quadrature phase portion 22, the received high frequency signal is sent to a mixer 54 that also receives a signal from a local oscillator in a PLL 56 to provide frequency down-conversion to an intermediate frequency analog signal. As with the transmit channel, the local oscillator in the PLL 56 receives a global clock signal for phase alignment and a programmable off-set is used for phase control. The intermediate frequency signals may be band-pass filtered by a band-pass filter 58, and may further be attenuated by an attenuator 64, and amplified by an amplifier 60 before being sent to an analog-to-digital converter 62 where the intermediate frequency analog signals are converted to digital signals. The digital signals in the in-phase portion 20 of the receive channel 14 are sent to an in-phase summer 66 where all of the in-phase signals from all of the receive channels 14 are added. Likewise, the receive signals in the quadrature phase portion 22 are sent to a quadrature phase summer 68. The added in-phase signals and the quadrature phase signals are then sent to the controller 30.

In another embodiment, the signals may be added at the IF level using a conventional corporate distribution network that are then used in any manner known to those skilled in the art.

As will be discussed in detail below, the phased array 10 includes various integrated components that accurately control the phase applied to the local oscillators and circuit components for providing accurate timing to synchronize the independent local oscillators used to create the phase shift.

Figure 2:
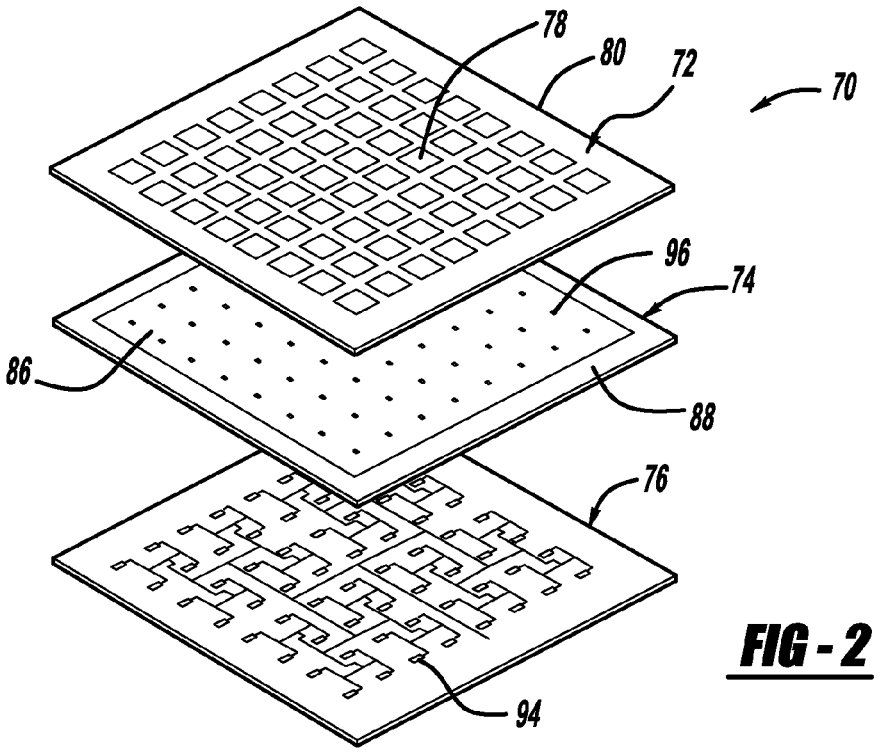
FIG. 2 is an exploded top perspective view of a layer architecture for a stacked phased array including an array layer, an interconnect layer and a packaging layer, according to an embodiment of the present invention.
Figure 3:
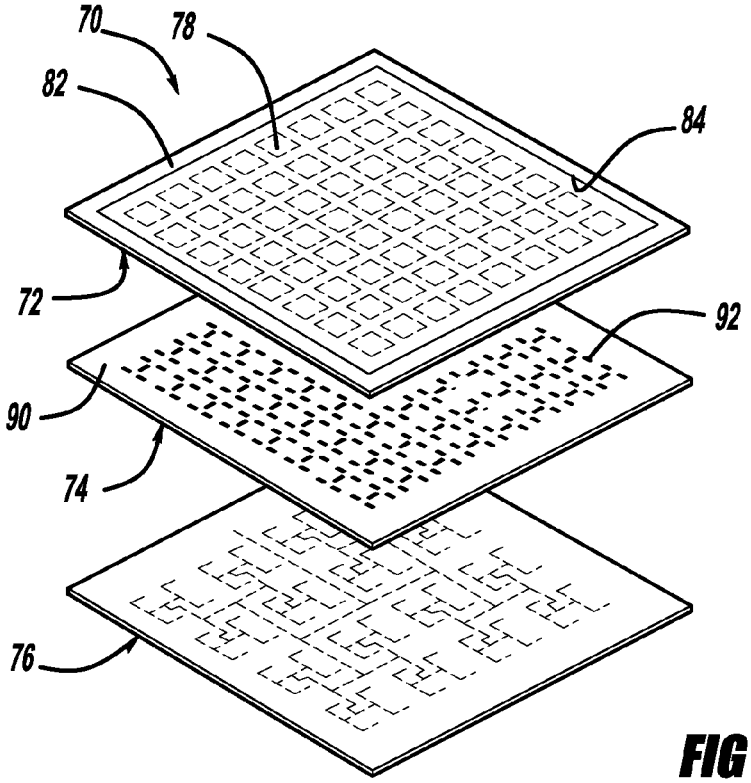
FIG. 3 is an exploded bottom perspective view of the layer architecture shown in FIG. 2.

FIG. 2 is an exploded top perspective view and FIG. 3 is an exploded bottom perspective view of a vertically integrated phased array 70, such as the phased array 10 shown in FIG. 1. In this non-limiting embodiment, the phased array 70 includes three stacked layers, particularly an antenna array layer 72 at the top of the array 70, an interconnect layer 74 in the middle of the array 70 and a packaging or control layer 76 at the bottom of the array 70. The layers 72, 74 and 76 can be made of any material suitable for integrated circuit fabrication, such as silicon, group III-IV semiconductor materials, polymers with suitable loss, such as parylene or liquid crystal polymers, fiber-glass substrates, such as FR4, high frequency substrates and laminates, such as those produced by Arlon, Taconic, Rogers Corporation, amorphous materials, such as glasses, and crystalline materials, such as quartz, LTCC, etc. In one embodiment, a plurality of patch antenna elements 78 are formed to a top surface 80 of the antenna array layer 72, where each patch antenna element 78 represents one of the antennas 24. An optional cavity 84 can be formed through a bottom surface 82 of the antenna layer 72 that allows the patch antenna 78 to resonate therein. The size of the patch antenna elements 78 determines the frequency band of the transmit and receive signals. It will be understood by those skilled in the art that any suitable antenna structure can be used other than the patch antenna elements 78 including, but not limited to, dipoles, folded dipoles, etc., and any suitable antenna may be formed over a cavity or directly onto a solid substrate.

For the cavity backed patch antenna embodiment, a metalized plane 86 including coupling slots 96 is formed on a top surface 88 of the interconnect layer 74 and acts as a ground plane for the patch antenna elements 78. A bottom surface 90 of the interconnect layer 74 includes a plurality of circuit components 92 fabricated thereon, and can include, for example, the PLLs 42 and 56, the mixers 40 and 54, the band-pass filters 44 and 58, the attenuators 50 and 64, the power amplifiers 46 and 48, the LNAs 52 and the amplifiers 60 in the phased array 10. Digital components 94 of the phased array 70 can be integrated or formed on the packaging layer 76, such as the digital-to-analog converters 36, the analog-to-digital converters 62, the band-pass filters 38, etc.

Each of the layers 72, 74 and 76 can be fabricated from a variety of different materials, such as silicon, organic substrates, such as liquid crystal polymers and/or parylenes, low-temperature co-fired ceramics (LTCC), and any microwave substrate that is suitable and capable of producing multi-layer structures. Further, conventional multi-layer printed circuit boards (PCB) can be used for the layers 72, 74 and 76. All of the necessary active components are mounted on the appropriate layer and are electrically connected to the circuits using any suitable technique, such as flip-chip connections or wire bonds. Further, the antennas, distribution networks and DC bias networks can be printed on the appropriate layer using a fabrication technology appropriate for each type of substrate. For example, screen printing can be used to fabricate metal lines on LTCC, photolithography can be used for fabricating metal structures on silicon, parylene and LCP. Vias may be formed through silicon layers using dry reactive ion etching (DRIE), vias can be formed in the PCB material either by mechanical or laser drilling, and vias can be formed in the green LTCC stack by drilling or die cutting. Such layering techniques can be used to form virtually any structure required to provide the entire RF system from the antenna to the active component interconnects and active component packaging.

The phased arrays 10 and 70 synchronize each active antenna element to a single global clock to perform digital phase-shifting on a locally generated LO signal. This removes the necessity for precise high-frequency distribution networks. The phased arrays 10 and 70 do not need to perform power combining or distribution at high-frequency, thereby achieving high watt/watt efficiency by not dissipating costly RF signals. Unlike RF distributed systems that use multi-stage amplification to compensate for signal loss in phase-shifters and variable attenuators, the phased arrays 10 and 70 produce all RF signals directly at each element. Each element operates as an independent radio channel, combining with robust IF-signal combining and distribution networks, the array is highly tolerant of multi-element failure. Because the high frequency distribution networks have been removed, the phased arrays 10 and 70 are well-suited to compact multi-layer PCB fabrication, allowing smaller system size and weight with higher mechanical stability when compared with single-layer PCB or silicon-based arrays.

As the frequency of operation and the degree of scan angle goes up, the ability to use patch antennas in the PCB architecture of the phased arrays 10 and 70 is reduced. Normally, the RFICs are mounted in internal cavities directly behind a planar element, but at higher frequencies, the element spacing becomes prohibitively small and a sub-array architecture may not be able to be used for wide scan angles. For these applications, the antenna element architecture needs to provide millimeter-wave efficiency, low-directivity, low-coupling, appropriate polarization, be economic to produce and be easily integratable with a PC board.

Figures 4A, 4B:
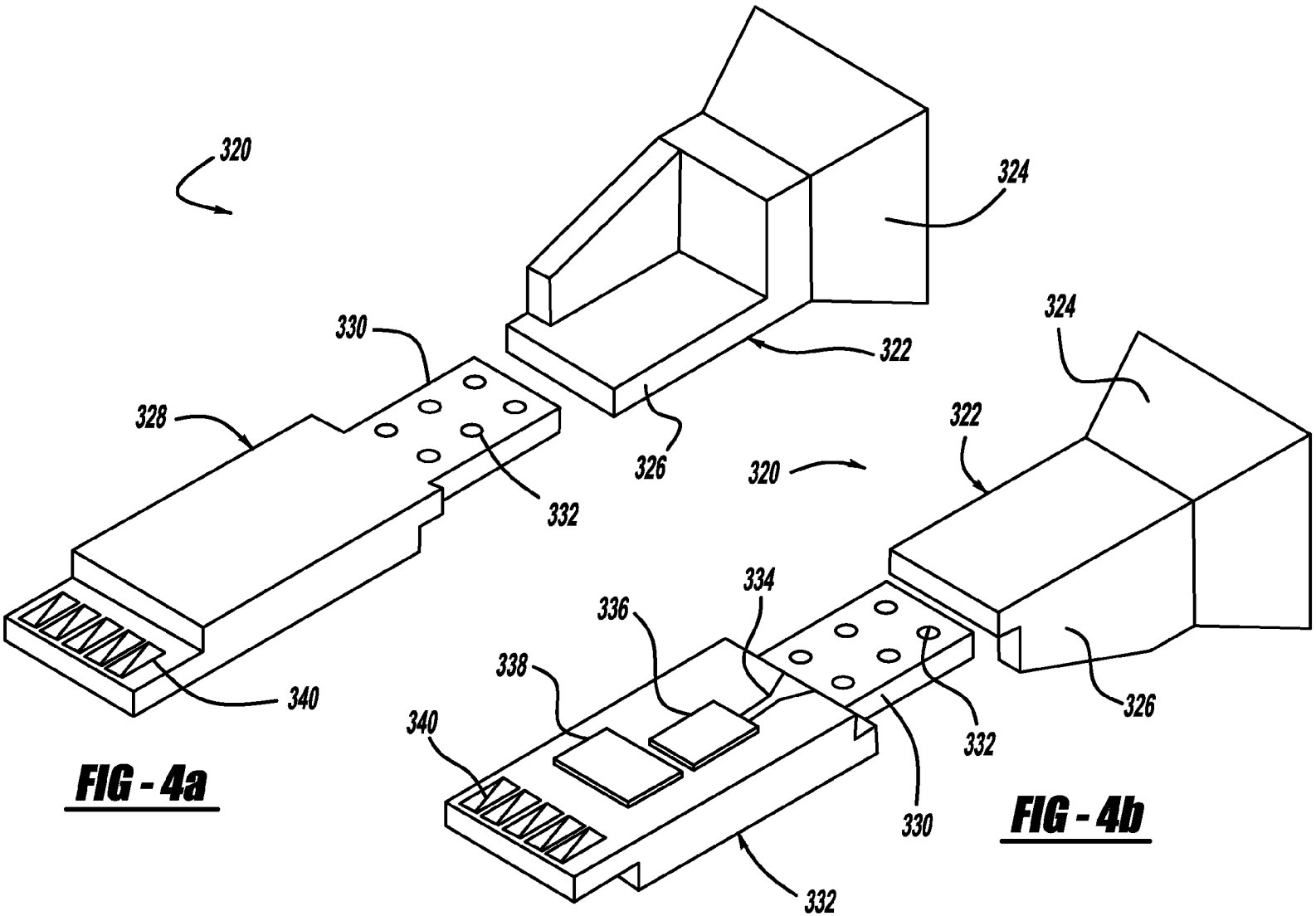
FIGS. 4(*a*) and 4(*b*) are a top perspective view and a bottom perspective view, respectively, of a filled antenna horn and RF circuitry applicable to be used in the vertically integrated electronically steered phased array shown in FIG. 1, according to an embodiment of the present invention.

FIGS. 4(*a*) and 4(*b*) are a top perspective view and a bottom perspective view, respectively, of a filled-waveguide antenna horn 320 that provides the properties discussed above. The horn 320 includes a horn element 322 including an expanded portion 324 and a base portion 326. The expanded portion 324 is filled with a suitable dielectric that operates to give the antenna horn 320 low-directivity and efficiency. The filled horn 320 provides the $\lambda/2$ spacing required for the array and maintains low directivity. The dielectric material should be castable, have low-moisture absorption and be impact resistant. The horn element 322 can be a metal plated material having desired impact properties. The horn element 322 can be cast independently and plated individually, or a plated mold can be provided that will be the surface of the element and the dielectric can be cast directly into the mold.

The filled-waveguide horn 320 also includes a printed circuit board (PCB) 328 having a connector end 330 that is configured to be coupled with the base portion 326. The connector portion 330 includes a plurality of connectors 332 that operate to secure the printed circuit board 328 to the horn element 322. The connectors 332 can be any suitable connector for this purpose, such as solder, pins, epoxy, etc. The PCB 328 also includes a feed line 334 that makes contact with the metalized portion of the horn element 322, and includes a flared portion to provide impedance matching. The feed 334 is electrically coupled to integrated circuits or RFICs 336 and 338 that provide some of the electronics for each channel in the phased array. For example, the RFICs 336 and 338 could include the mixer 40, the PLL 42, the filter 44 and the amplifiers 46 and 48 in the transmit channel 12 and/or the LNA 52, the mixer 54 and the PLL 56 in the receive channel 14. The horn element 322 would be the antenna 24, and could be only a receiver antenna, only a transmitter antenna or a transceiver antenna depending on the particular application. The RFICs 336 and 338 are coupled to connectors 340 that would be coupled to edge connectors, such as on the control layer 76 in the phased array 70. The filled-waveguide horn 320 will be configured vertically relative to the plane of the layer 76, and will provide the desired polarization.

Figures 5A, 5B:
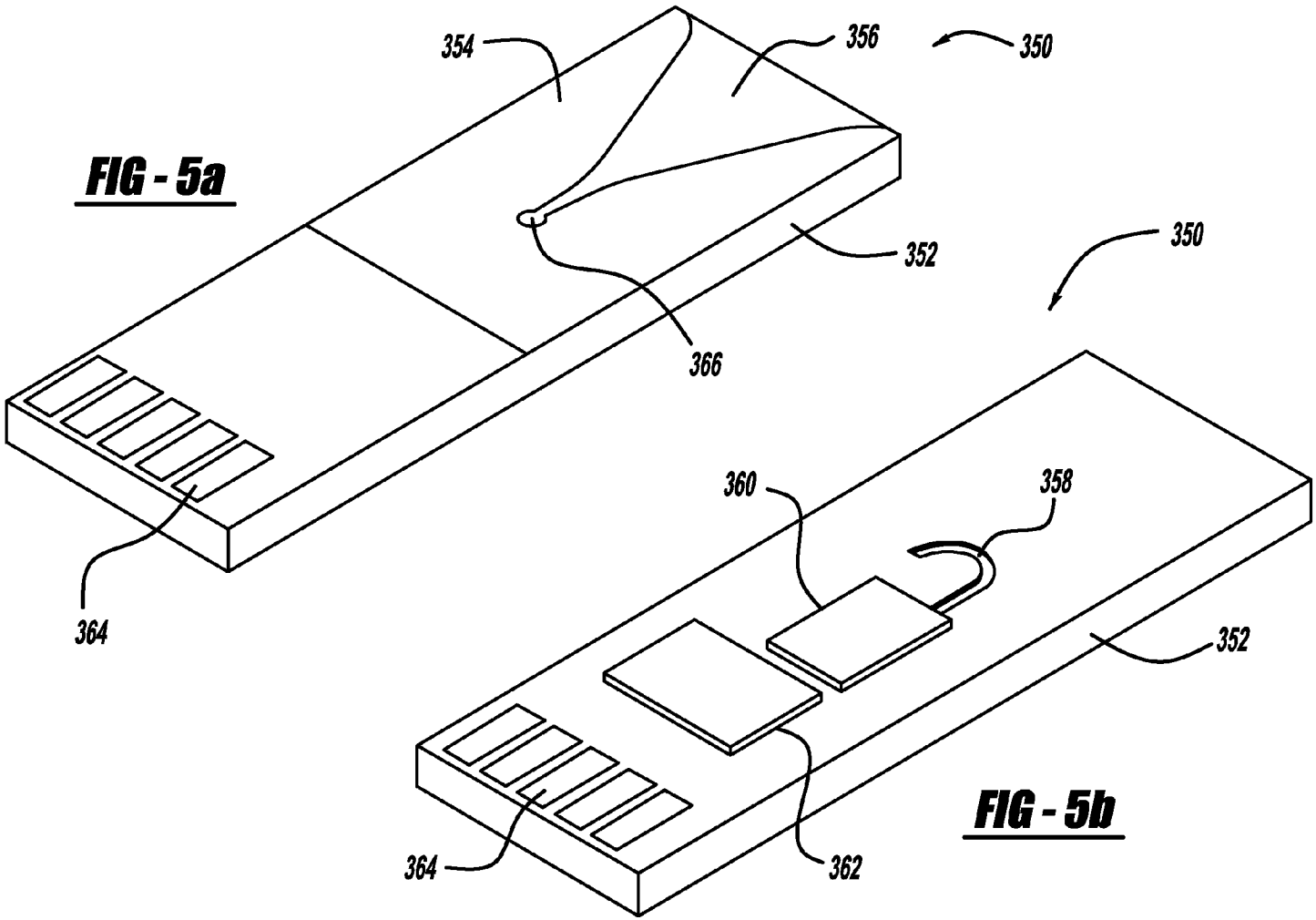
FIGS. 5(*a*) and 5(*b*) are a top perspective view and a bottom perspective view, respectively, of an antenna and related circuit that can be used in the vertically integrated electronically steered phased array shown in FIG. 1, according to another embodiment of the present invention.

FIGS. 5(*a*) and 5(*b*) are a perspective top view and a perspective bottom view, respectively, of an antenna circuit 350 that also provides the desired characteristics and properties at high frequencies for the phased arrays discussed above. The antenna circuit 350 includes a dielectric substrate or layer 352 on which is formed a metalized layer 354 that is patterned to define an antenna element 356, such as a tapered-slot type antenna. RFICs 360 and 362 are provided on a back side of the layer 352, and can include the same circuit components as the RFICs 336 and 338. An antenna feed 358 is electrically coupled to the RFIC 360 by a via 366 that extends through the layer 352 and is electrically coupled to a feed location of the antenna element 356. Connectors 364 are electrically coupled to the RFICs 360 and 362, and can be coupled to edge connectors, such as on the control layer 76, as discussed above. The antenna circuit 350 is also vertically oriented relative to the PCB layer.

The present invention employs components and techniques so that the phase shift for the local oscillators in the phased arrays 10 and 70 are provided by using a tunable or programmable phase locked loop (PLL) that can provide phase control. The combination of these two technologies can provide a superior phased array in as many bits of phase accuracy is possible. Also, the control of the phased array is greatly simplified because a simple digital data buffer can be used to control the state of the PLL. This differs from previous disclosures in that phase shifting is provided for a radio on the LO, the clock is not phase shifted and each channel forming the phase shift is an independent signal generator that is synchronized to a global clock, which provides an absolute reference. Thus, for instance, a phase off-set can be provided that is important in correcting for manufacturing variances. Likewise, the low-level phase control can be written to a data register so that the PLL can provide the phase off-set without the need for continual control.

As mentioned above, programmable PLLs can be used to control the clock signal applied to the local oscillators for phase control. These oscillators can be set with a specific phase off-set with respect to a global reference clock. This means that a phased array can be formed by providing the appropriate phase off-set between elements. The operation of the phase off-set programmable oscillator allows for the control through a data register. This provides control of any relative phase off-set between zero and $2\pi$. This can be used to form any number of phased array beams by recognizing the fact that the sum of any two sine waves of the same frequency is a sine wave at the same frequency, but with a unique amplitude and phase off-set.

In the general case with varying amplitudes and phases, the resulting sum is a sine wave at a different phase and amplitude, but at the same frequency. Because steering a beam using this condition requires adjusting the relative phase between the antenna elements in the array, and that this compromises separate oscillators each with independently controlled phases that are the same frequency, then it is clear that two beams may be formed simultaneously by forming an oscillation with the correct amplitude and phase for the sum of the two required oscillations. In fact, N beams can be formed using the same principle and any desired amplitude tapering may also be included.

For this effect to be most useful, compensating amplification needs to be included. This is necessary because in both transmit and receive, power is divided between the channels formed by the beams. Thus, it is important to include amplitude compensation as part of the design. For example, if two simultaneous beams are to be formed, 3 dB of additional gain is required at the output of the transmitter and/or the input of the receiver. If ten simultaneous beams are to be formed, 10 dB of additional gain will be required. Such gain may be present in an adjustable form to optimize power consumption or may be fixed. Techniques for producing adjustable gain can be provided by voltage programmable amplifiers, switchable parallel amplifiers, where the switches may be addressed as much as required, a combination of these, etc.

Figure 6:
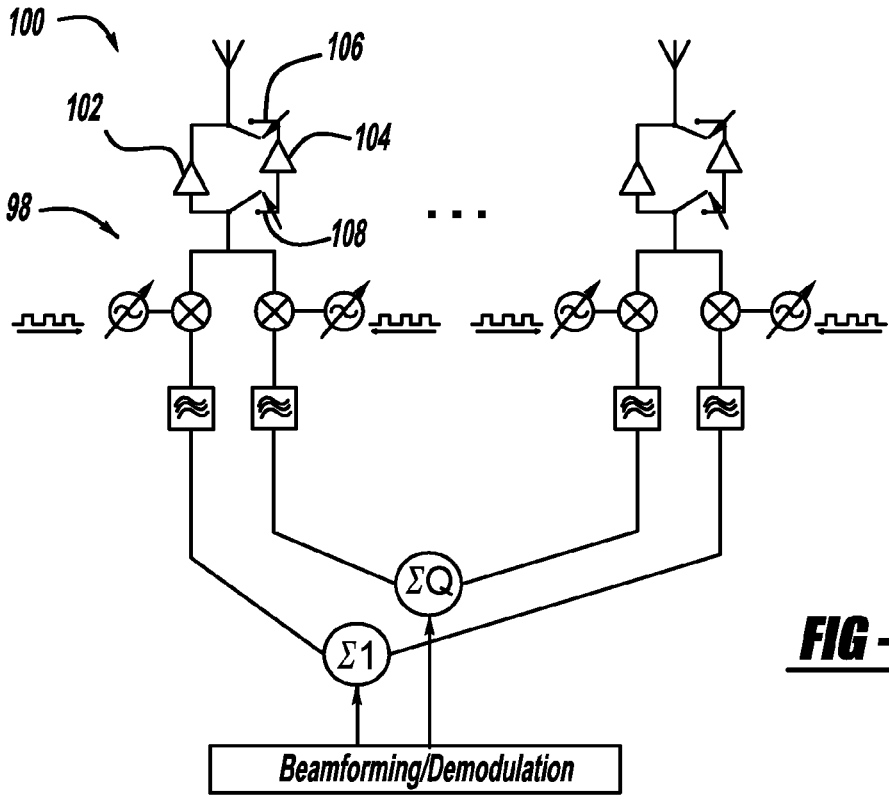
FIG. 6 is a schematic diagram of a phased array similar to the array shown in FIG. 1 that provides additional transmit power for multi-beam operations, according to another embodiment of the present invention.

FIG. 6 is a schematic diagram of a phased array 100, similar to the phased array 10, that includes a plurality of transmit channels 98 having in-phase and quadrature phase portions. In the phased array 100, additional amplification can be switched into a power amplifier 102 in the transmit channels using switches 106 and 108 to couple another amplifier 104 in parallel with the power amplifier 102, as shown. The amplifier 104 provides the amplitude compensation for forming an oscillation array of the sum of two oscillations. Although this embodiment shows the use of amplifier 104 to provide the additional amplification, it would be appreciated by those skilled in the art that any other device that provides power addition, programmable gain, etc., that is suitable for this purpose can be employed.

It has been recognized that the distribution of accurate timing control, typically in the scale of picoseconds, and even femtoseconds for frequencies over 60 GHz, is often a limiting factor to system performance. This is particularly important in phased arrays that rely on the distribution of a global clock. There are several important features to all systems that require accurate distributed timing. Manufacturing tolerances in semiconductor devices and transmission lines lead to skew and jitter phase errors, known to those skilled in the art. The variations in PCB line dimensions, variations in integrated circuit device delays, phase noise in oscillators, and cross-talk between digital and reference timing circuits leads to overall timing distribution errors that can significantly degrade system performance.

Figure 7:
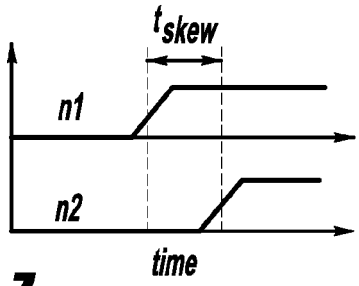
FIG. 7 is a graph showing signal skew.
Figure 8:
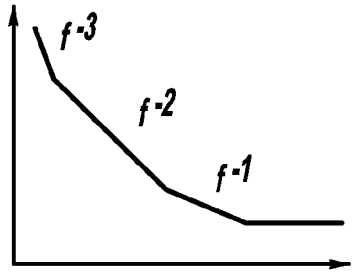
FIG. 8 is a graph showing signal phase noise.
Figure 9:
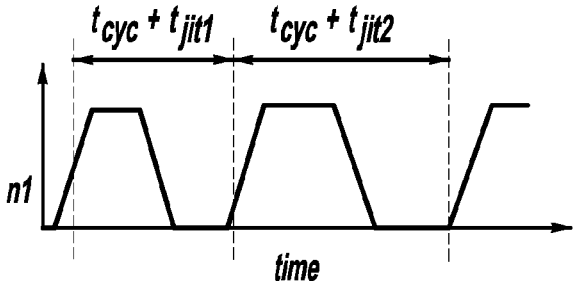
FIG. 9 is a graph showing signal jitter.

FIG. 7 is a graph that shows signal skew, FIG. 8 is a graph that shows component phase noise and FIG. 9 is a graph that shows signal jitter.

The power associated with the distribution of clock signals is often significant in high speed clock networks, especially in CMOS based devices. The cost of accurate timing distribution can often preclude the use of extremely accurate timing distribution systems if the distribution must support fan-out levels in hundreds of devices. For these reasons it is important to identify a technique of precise reference timing that is both extremely accurate, and cost and power effective.

One method for providing accurate timing is to distribute a clock signal by providing phase accurate distribution, such as found in traditional driver networks, cabling networks, etc. However, such systems are limited by fan-out of the clock source, that is, the number of elements that can be driven directly by a frequency source. The present invention provides a system that can provide clock distribution to large numbers of circuit elements.

Figure 10:
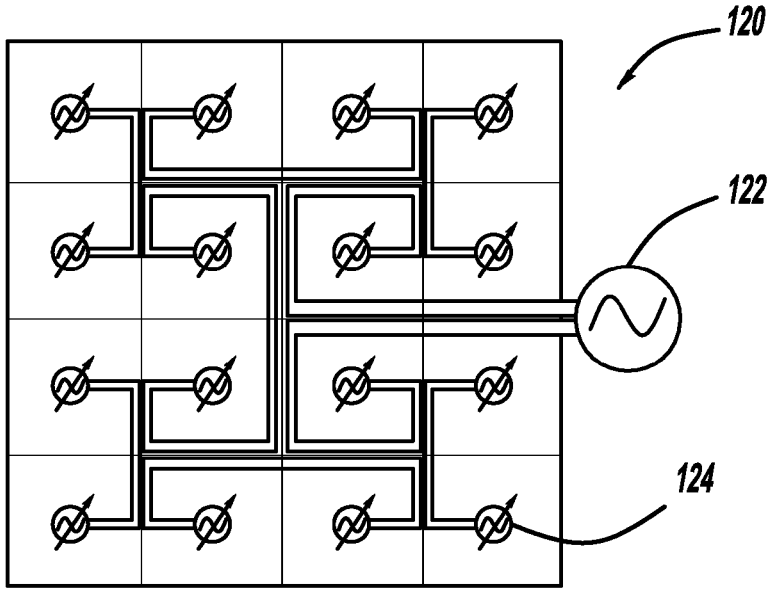
FIG. 10 is a plan view of a resonant H-tree distribution network, according to an embodiment of the present invention.

FIG. 10 is a top plan view of a resonant H-tree distribution network 120 that can be used as a clock signal distribution network for distributing a highly accurate clock signal to a large number of elements, according to an embodiment of the present invention. The H-tree network 120 accurately distributes a clock timing signal from a local oscillator 122 to the local oscillators in PLLs 124 located at the terminal nodes, i.e., the leaves, of the distribution network 100 are programmable. The PLLs 124 provided a signal having a controlled phase relative to all of the signals from the other PLLs 124 to provide phase compensation in response to signal skew, component phase noise and signal jitter. Thus, the H-tree network 120 can be affective for distributing the local oscillator signals from the PLLs 42 and 56 in the array 10. In this example, the distribution network 100 includes sixteen nodes.

The resonant H-tree architecture provides a high precision timing network where a clock signal can be distributed over a large number of elements. The basic element is a programmable oscillator where some of the oscillators operate at low frequencies and some of the oscillators operate at high frequencies. This provides correct phase shifts across an array when many elements are placed along an array edge. For example, if a phased array beam is to be steered to an angle $\theta$ and the array elements are spaced at $\lambda/2$; then each element from the array has a progressive phase shift of $n\pi \sin \theta$ radians. However, a PLL will wrap around the phase shift every $2\pi$ radians. This limitation becomes an important consideration for phased arrays that are based on programmable PLLs that can be tuned to provide a reference phase shift with respect to the other PLLs.

For the purposes of illustration, assume that there are sixty-four antenna elements on a side of the array. Then, the next four elements should start with an offset of $2\pi°$radians of phase shift and end with $4\pi$ radians of off-set. This pattern continues until the last four element grouping would begin at $30\pi$ radians of off-set and end at $32\pi$ radians of phase shift. In this example, it would take approximately 16 cycles of a carrier for the phase front to become coherent, i.e., be at full power. The consequence of this is most noticeable on high bandwidth signals. Consider an encoded signal with a chip rate in the microsecond range where the signal has a carrier frequency in the 10 GHz range, and in this case for a 1 microsecond pulse, approximately 0.02% of the signal energy will be affected. On the other hand, for a 1 GHz bandwidth on the same carrier, 20% of the bandwidth is affected. It is important to note that in this example, the steer angle is 30°. For a 60° steer angle, approximately 35% of the bandwidth is affected with a substantial energy loss. Thus, for large steer angles, large arrays and high bandwidths it is important to be able to provide additional phase shift across the array so that modulation events are aligned with as nearly an ideal phase front as possible.

Given a programmable PLL that allows for a differential phase shift between PLLs as referenced to a common system clock, then additional phase shifts may be applied by forming clock layers. In this case, a 50 MHz clock signal can be distributed to the first layer of the programmable PLLs that up-converts the MHz clock to a 1 GHz signal. These PLLs can be programmed to account for skew effects during layout. The distributed clock arrangement is capable of additional phase shift to account for skew in the H-tree distribution network or in any clock distribution that worked in general providing improved array performance.

Figure 11:
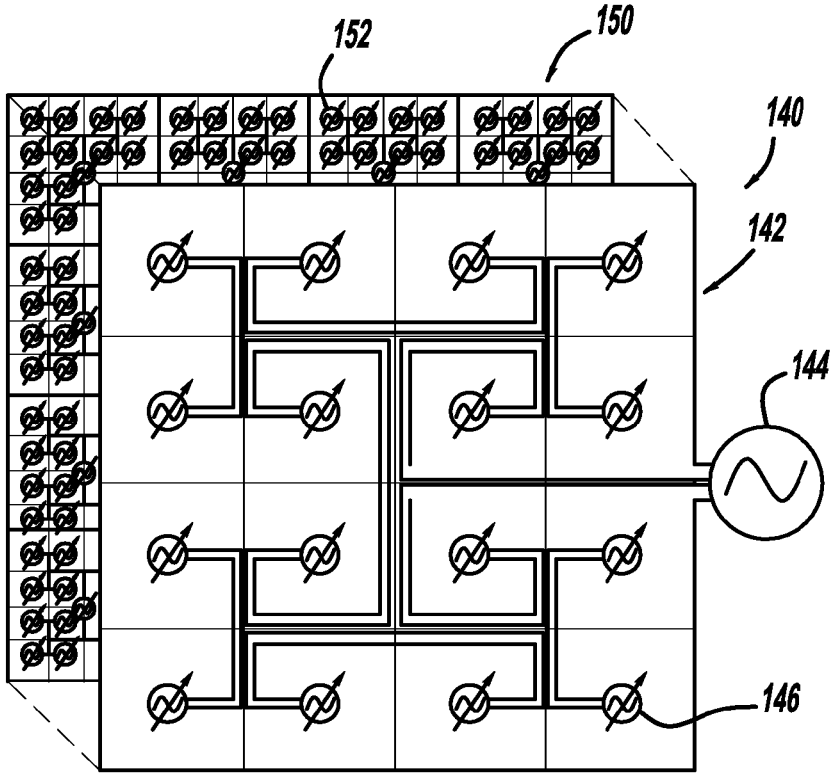
FIG. 11 is a perspective view of a cascaded resonant H-tree timing distribution network where each leaf of an upper H-tree feeds another H-tree on a lower level, according to an embodiment of the present invention.

FIG. 11 is a perspective view of a clock distribution network 140 that can be used to control a large number of programmable PLLs in a phased array, according to an embodiment of the present invention. The distribution network 140 includes a top distribution network 142 similar to the distribution network 120. Particularly, the top distribution network 142 includes an oscillator 144 typically operating at a low frequency, such as 50 MHz. The oscillator signal from the oscillator 144 is distributed to a plurality of PLLs 146 at the nodes of the network 142, as shown. The oscillators in the PLLs 146 operate at a higher intermediate frequency, for example, 1000 MHz. Each of the oscillators in the PLLs 146 is then used to drive a separate H-tree distribution network 150 at a second level of the clock distribution network 140. Particularly, the oscillator in a PLL 146 operates as the oscillator 144 for a distribution network at a higher frequency. Here, there are sixteen of the distribution networks 150 in the second level, each including a PLL 152. Each of the oscillators in the PLLs 152 is the local oscillator in each of the transmit and receive channels in the phased array that includes a programmable clock signal. In one example, the oscillators in the PLLs 152 operate at about 22,000 MHz.

Use of a PLL allows more correction of phase errors in the clock distribution network 140. This feature can be important for high-bandwidth phased array antennas. In general, it should be noted that other resonant and even non-resonant structures could be used to form the clock distribution layers provided that suitable timing accuracy can be maintained.

Figure 12:
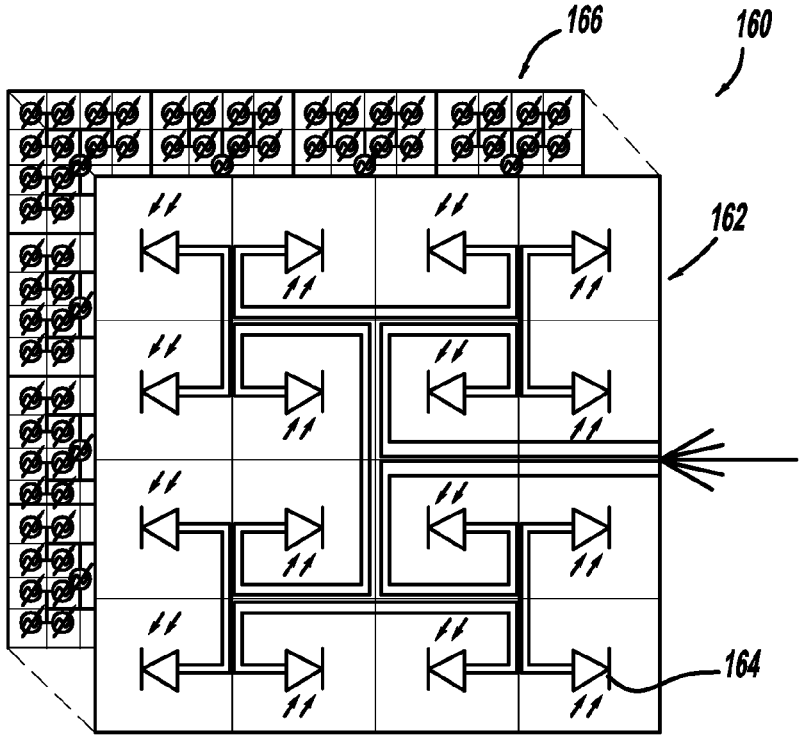
FIG. 12 is a perspective plan view of a distribution network driven by optical sensing elements, according to an embodiment of the present invention.

FIG. 12 is a perspective view of a distribution network 160 that employs an optical network 162 at the top layer. The distribution network 160 could be composed of fibers split into phase controlled independent paths and distributed from a single modulated laser. The terminal nodes of the optical network 162 include an optical-to-electric conversion device 164, such as photodiodes, phototransistors, or any other device for optical edge detection well known to those skilled in the art. The optical-to-electric conversion devices 164 convert the modulated laser pulses into an electrical train that are used to drive H-Tree distribution networks 166 at the second level. RF synchronization using a received monotone at an antenna is then distributed to the H-tree distribution network 166.

Figure 13:
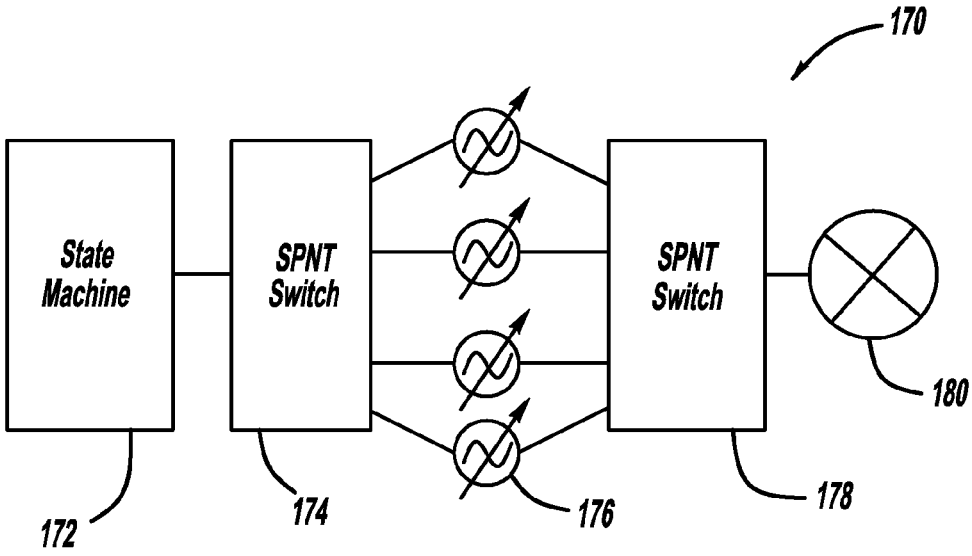
FIG. 13 is a schematic block diagram of a switchable programmable phase locked loop that employs multiple oscillators for wide-band applications, according to an embodiment of the present invention.

FIG. 13 is a schematic block diagram of a switchable programmable PLL 170 that can be used to provide a local oscillator signal in the phased array 10. A clock distribution layer for the PLL 170 can include the distribution networks discussed above. A state machine 172 controls the PLL 170, and provides a signal to an SPNT switch 174 that selects a particular frequency band by selecting one of a plurality of oscillators 176. The output of the selected local oscillator 176 is then sent to another SPNT switch 178 that transfers the selected local oscillator signal to a mixer 180. To reduce the overall noise of the PLLs, the bandwidth is limited in this design. Thus, to provide a wider bandwidth of operation, multiple PLLs can be switched into the local oscillator feed structure of the mixer 180. The mixer 180 in this case, and in the case of all configurations, may be of the direct conversion type or the sub-harmonic type.

Figure 14:
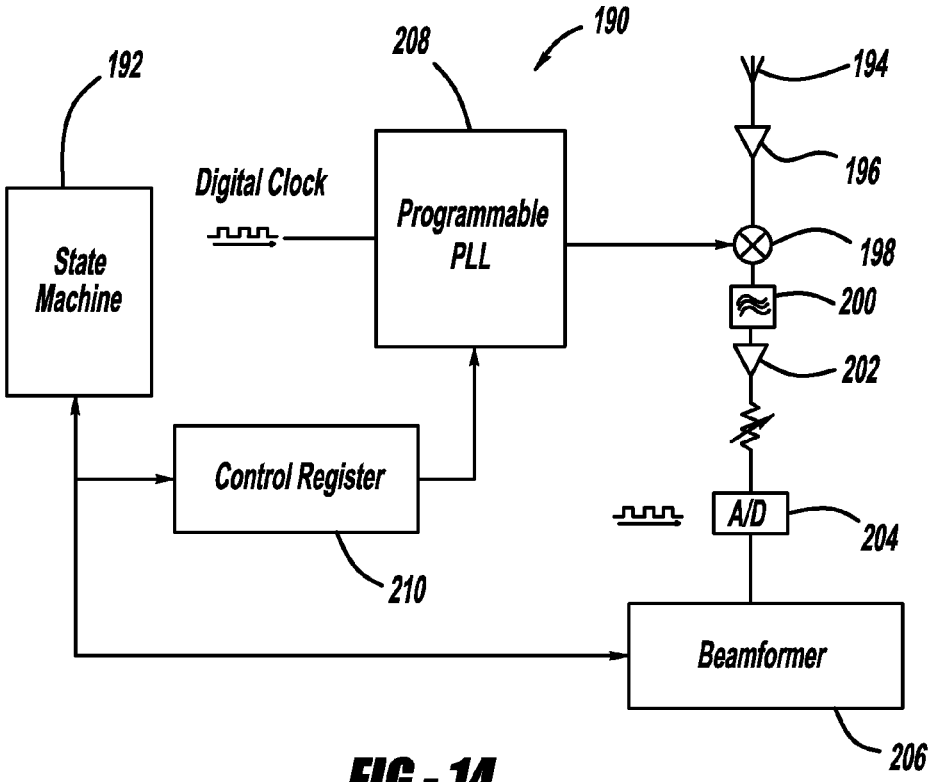
FIG. 14 is a schematic block diagram of a circuit controlled by a state machine for providing beamforming control, according to an embodiment of the present invention.

FIG. 14 is a schematic block diagram of a receive channel 190 for a phased array employing a state machine 192. In this embodiment, the state machine 192 is provided for each transmit channel 12 and receive channel 14 of the array 10. The receive channel 190 includes an antenna 184, an LNA 196, a mixer 198, a band-pass filter 200, an amplifier 202, an analog-to-digital converter 204 and a beamformer 206 of the type discussed above in the phased array 10. The state machine 192 controls a programmable PLL 208 that provides the programmable LO signal to the mixer 198, as discussed above. A control register 210 stores the command from the state machine 192 to the programmable PLL 208.

The state machine 192 may be integrated into the RFIC circuit and controls the feedback loop of the programmable PLL 208 through the control register 210, which also may be integrated into the RFIC. The beamforming network 206 provides instructions to the state machine 192 in coordination to facilitate combining and processing of the individual array channels so that beams may be formed according to a method of operation. The state machine 192 can provide multiple functions including scanning, adaptive beamforming, switching, amplitude modulation, temperature compensation, offset error calibration and tracking. Particularly, the state machine 192 can form a single beam by combining all of the elements of the array and steer it by adjusting the phases on each programmable PLL and the amplitude of the combined PLLs. One method of amplitude control is to provide an attenuator on the IF channel, which may also be controlled by the state machine 192. Moreover, the state machine 192 can be used for scanning multiple beams. In that case the scan time can be reduced as 1−N because each beam can scan less area.

The state machine 192 can also be used for providing adaptive beamforming operations. In the presence of a jammer, the state machine 192 can acquire the angle of arrival of the jamming signal after an initial scan by, for example, post processing of the phase delay added in each PLL, and by using any existing digital beamforming algorithm, it can create a null in that direction. The state machine 192 can also be used for switching different PLLs in the system for broadband operation. The state machine 192 can correct for any temperature drifts in the PLL 208 or other active circuits due to temperature variations along the entire system. The state machine 192 can provide error correction skew, for example, skew that arises from buffering a clock signal in a PLL. In such a case, calibration of the system after assembly can be used to provide off-set information. The use of a system, such as an electro-optical mapping system, can measure the individual phase and amplitude of each channel providing a set of temperature correlated deterministic corrections that can be stored in non-volatile memory in each state machine and that can be applied to provide correct phase and amplitude for each channel to improve beamforming. Alternately, such corrections can be loaded into the volatile memory of each state machine from the beamformer when the system is powered on or even during operation.

As discussed above, a phased array architecture can be fabricated using a variety of materials and a variety of fabrication techniques. The present invention provides a phased array architecture that is a fully vertically integrated realization of an entire phased array with all of the required art of passive components, as well as all of the active components required to form a system capable of digital beamforming, where all of the components can be formed on single layer substrates with local oscillator phase shifting capability. This is critical if the overall package is to be minimal in that the overall package will be of minimal thickness and/or planar dimensions no larger than that required to form the antenna aperture. It is important to recognize that unlike known systems, the RFICs may or may not be monolithically integrated. For example, one RFIC might be comprised of the PLLs, one RFIC may include data registers and a state machine, another RFIC may be a power amplifier or a low noise amplifier and another RFIC may include the mixers.

The RFICs can also be fashioned from appropriate technologies, such as SiGe, GaAs, InGa, As, silicon or any suitable semiconductor. The RFICs likewise might be fully integrated into single monolithic RFICs or any suitable combinations of these. The techniques of connection between the vertical integrated RF circuits might contain the antennas, filters and RF interconnects, and the RFICs might be flip-chip transitions that connect the output/input of the RFICs to the antennas and intermediate frequency lines. Similarly, the connection might be comprised of wire bonds that can be used to realize such connections.

Figure 15:
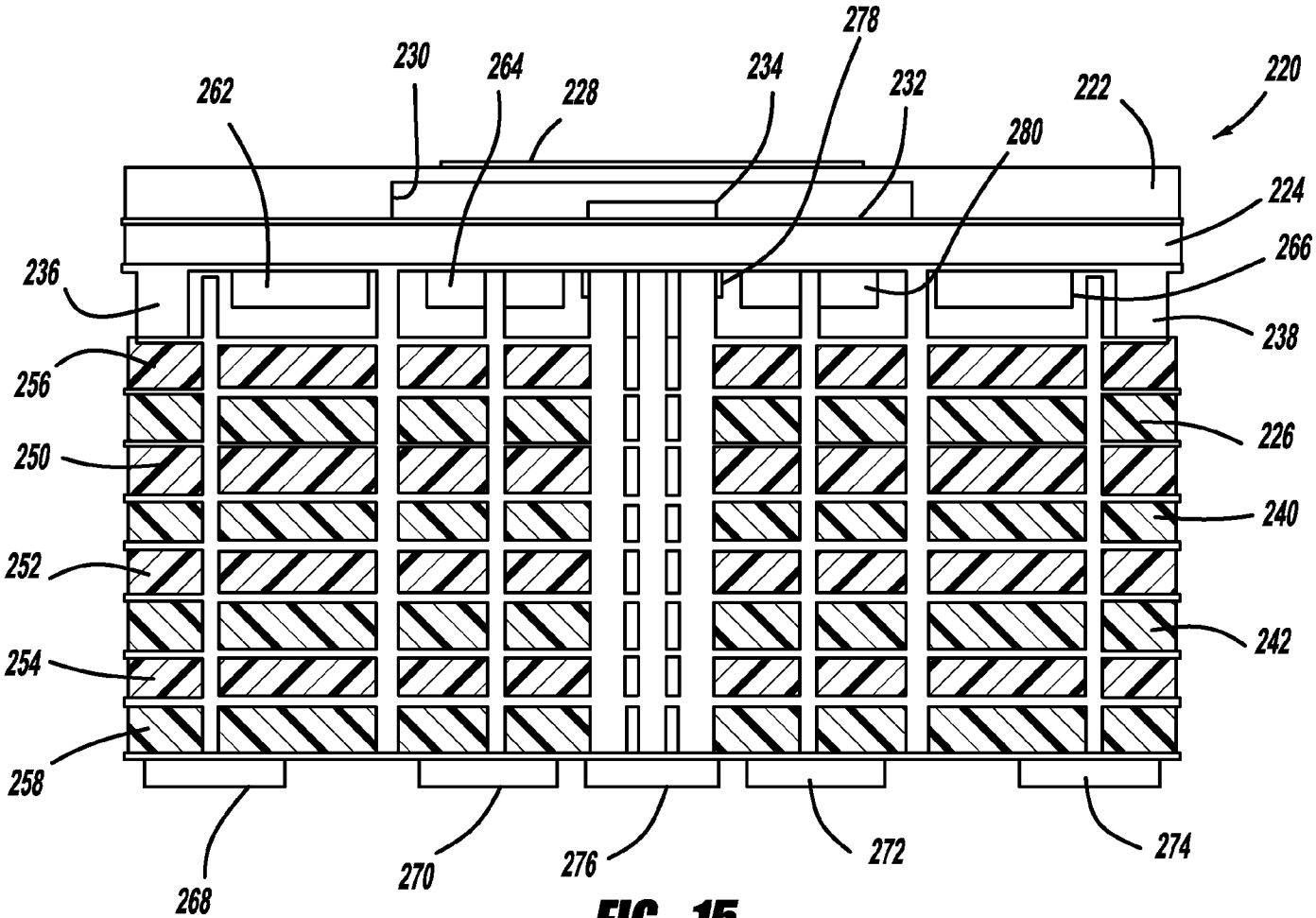
FIG. 15 is a cross-sectional plan view of a vertically integrated phased array including a plurality of stacked layers, according to an embodiment of the present invention.

FIG. 15 is a cross-sectional view of a stacked phased array 220 of the type discussed above showing a plurality of stacked layers, and one possible configuration of the various components in the array 220. The array 220 includes an antenna layer 222, an interconnect layer 224 and a plurality of packaging layers 226. The antenna layer 222 for the embodiment shown includes an antenna 228 on a top surface and a cavity 230 formed through a bottom surface of the layer 222. A ground plane 232 is formed on a top surface of an interconnect layer 224, and a TR switch 234 is provided on the ground plane 232 within the cavity 230. The interconnect layer 224 is coupled to the plurality of the packaging layers 226 by suitable devices, such as solder balls and gold bumps 236 and 238. The plurality of packaging layers 226 are separated by metalized layers 240 and a series of vias 242 extend through the plurality of the layers 226. One of the packaging layers 250 can be an intermediate frequency distribution layer for the in-phase portion, one of the packaging layers 252 can be an intermediate frequency distribution layer for the quadrature phase portion, one of the packaging layers 254 can be a DC distribution layer, one of the packaging layers 258 can be a clock distribution network and one of the packaging layers 260 can be a digital layer. Various components can include programmable PLLs 262, control registers 264, state machines 266, controllers 268, analog-to-digital converters 270, digital-to-analog converters 272, transmission controllers 274, clock drivers 276, power amplifiers and low noise amplifiers 278, mixers 280, etc. Instead of using a signal oscillator, each of the in-phase portions and quadrature phase portions of the transmit channels 12 and the receive channels 14 can employ a plurality of oscillators which are selected to give broad-band operation of the phased array 220.

It is important to recognize that the ADC/DACs may or may not be present on each channel and that the IF signals may be combined completely or with various levels of hybridization between complete integration and digitization at each channel. For example, one option has the I/Q channel separated, digitized and then summed. A second option includes the channel summed first and then digitized. A third option is to use a single IF signal not separated into in-phase and quadrature phase paths and digitized. A fourth option is to choose a hybrid approach where some channels are added and some are not in order to form multiple independent beams. Likewise, in the case of a transmit/receive switch for the receiver and transmitter, only this switch may or may not be present. As previously stated, the power amplifiers and/or the low noise amplifiers may or may not be integrated with the mixer, and the PLL may or may not be integrated into a single RFIC containing all of the active components. The clock distribution lines may or may not be combined into single distribution points as may the digital control mines. Further, the antennas may be integrated into the stack or may be attached separately.

The control circuitry includes multiple control signals. The most important signal is from the clock distribution network. The network contains a resonant H-tree network terminated in the programmable PLLs or as previously described may be provided by any other suitable device. Planar inductors (not shown) may be added in each leaf of the H-tree resonate network. These inductors combine with the distributed capacitance of the H-tree resonate network at a desired frequency. A power clock generator is used to periodically replenish the energy losses of the system and maintain the amplitude of the oscillation. The outcome of this is a low skew and jitter clock distribution network. Therefore, the number of via transitions needed to transfer the timing to each PLL is minimal. A resonate H-tree network can be used for distributing a low-jitter clock signal of the required frequency to the programmable PLLs. In order to reduce cross-talk between the clock traces, guard traces grounded with closely spaced vias may be used. In order to increase the oscillation between layers, all remaining distribution networks can be implemented with the strip lines. The thickness of each layer and the position of shielding layers should be optimized in order to reduce cross-talk and also maintain impedance matching for the distribution networks. Multiple vias can be used for transitioning the signals between layers all the way to the top of the array. Further, multiple vias can be used for ground equalization and suppression of parasitic modes. Further, thermal vias can be used to transfer heat out of the structure and into a cooling system attached at the back side of the array architecture.

Figure 16:
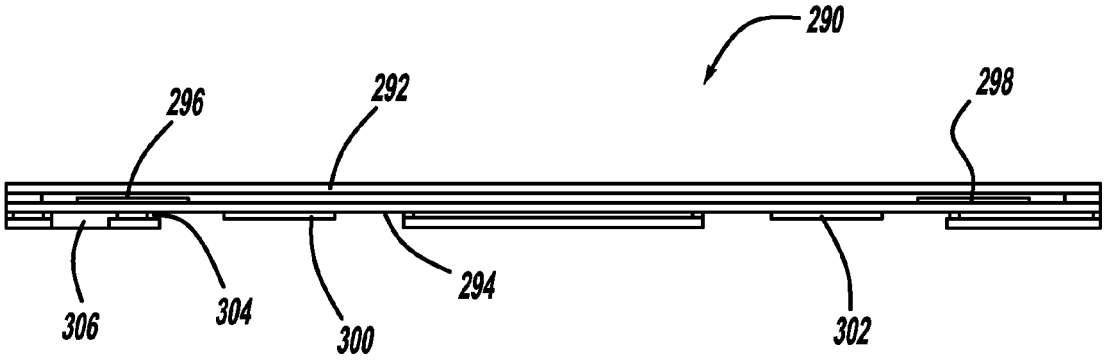
FIG. 16 is a cross-sectional view of an antenna array layer and an interface layer, including devices for reducing thermal resistance within a vertically integrated phased array, according to another embodiment of the present invention.

FIG. 16 is a cross-sectional view of a layered structure 290 including an antenna layer 292 and an interconnect layer 294, according to another embodiment of the present invention. In this architecture, transmit amplifiers 296, receive amplifiers 298, transmit mixers 300, receive mixers 302, via bumps 304, etc are shown. Also shown is a device 306, such as a heat pipe, that reduces the thermal resistance between RFIC layers and packaging layers, such as a solid metallic conductor or a heat pipe thermally joined to the layer with a soldered connection.

One concern for the phased array architecture is thermal management, particularly the removal of heat from the active components, mainly the power amplifiers, which might be integrated within the multi-layered structure. According to the invention, one option is to use the heat pipes 306 for heat removal. As is known in the art, heat pipes of this type include some fluid medium that can undergo a phase transition in a contained environment, such as water or alcohol, which is wicked up along the sides of the pipe. Heat generated at the contact point then causes the phase transition of the fluid medium and heat is removed by the vapor phase from a particular location and transferred to a heat rejection location as the vapor circulates within the pipe. The heat pipes 306 can be inserted inside the structure through etched holes formed by laser, DRIE, chemical etch, etc, and then soldered on a metal surface that is in contact with a heat generator. The removed heat can then be transferred to a heat exchanger located at the back side of the architecture.

A second option is to use thermal vias to transfer the heat on the back side of the architecture. In this case, multiple thermal vias can be placed in close proximately to the amplifiers in order to transfer the heat to an appropriate heat exchange point. In either case, heat generated by components on the digital layer may also be attached to the heat sink by soldered connection, by mechanical connection to the package or any other suitable technique.

Another option is to use a low-thermal resistance layer in the formation of the stack, such as thick metal layers, high conductivity substrates that can allow heat to move with minimum spreading from generating source to heat rejection points, such as thermal vias or the like.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A vertically integrated phased array comprising:

a plurality of stacked layers including;

an antenna layer having a plurality of antennas, an interconnect layer having a plurality of receive and transmit components, and at least one packaging layer having a plurality of digital components, wherein the plurality of receive and transmit components include a plurality of receive programmable phased locked loops each including a plurality of local oscillators providing a wideband local oscillator signal having a controlled phase and a plurality of transmit programmable phased locked loops each including a plurality of local oscillators providing a wideband local oscillator signal having a controlled phase, wherein the receive and transmit programmable phased locked loops receive control data that sets the relative phase of the local oscillator signals to control the phase of receive signals and transmit signals.

2. The phased array according to claim 1 wherein the receive programmable phase locked loop is part of a receive distribution network including a top layer and a bottom layer, said top layer including a local oscillator that controls a phase locked loop at a plurality of nodes of the top layer of the receive distribution network, and the phase locked loop at the plurality of nodes of the top layer each control a subset of the plurality of receive programmable phase locked loops in the separate receive channels.

3. The phased array according to claim 1 wherein the transmit programmable phase locked loop is part of a transmit distribution network including a top layer and a bottom layer, said top layer including a local oscillator that controls a phase locked loop at a plurality of nodes of the top layer of the transmit distribution network, and the phase locked loop at the plurality of nodes of the top layer each control a subset of the plurality of receive programmable phase locked loops in the separate transmit channels.

4. A vertically integrated phased array comprising:

a plurality of transmit channels including;

a plurality of transmit components-nodes, said transmit components nodes providing a transmit distribution network including a top layer and a bottom layer, said top layer including a local oscillator that controls a phased locked loop at the plurality of nodes in the top layer of the transmit distribution network, and the phased locked loop at the nodes of the top layer each control a programmable phased locked loop in the bottom layer for separate transmit channels.

5. The phased array according to claim 4 wherein the phased array is configured as a stack of layers including an antenna array layer having a plurality of antennas, an interconnect layer including the plurality of receive and transmit components nodes and at least one packaging layer having a plurality of digital components.

6. The phased array according to claim 4 wherein the programmable phase locked loops in the bottom layers each include a plurality of local oscillators for providing wide bandwidth.

* * * * *